US007619594B2

(12) United States Patent
Hu

(10) Patent No.: US 7,619,594 B2
(45) Date of Patent: Nov. 17, 2009

(54) DISPLAY UNIT, ARRAY DISPLAY AND DISPLAY PANEL UTILIZING THE SAME AND CONTROL METHOD THEREOF

(75) Inventor: Shuo-Hsiu Hu, Tainan (TW)

(73) Assignee: AU Optronics Corp., Hsinchu (TW)

( * ) Notice: Subject to any disclaimer, the term of this patent is extended or adjusted under 35 U.S.C. 154(b) by 612 days.

(21) Appl. No.: 11/247,414

(22) Filed: Oct. 11, 2005

(65) Prior Publication Data

US 2006/0262047 A1 Nov. 23, 2006

(30) Foreign Application Priority Data

May 23, 2005 (TW) ..... 94116739 A

(51) Int. Cl.
*G09G 3/30* (2006.01)
*G09G 3/32* (2006.01)
*G09G 3/10* (2006.01)

(52) U.S. Cl. ..... 345/76; 345/77; 345/78; 345/79; 345/80; 345/81; 345/82; 345/83; 315/169.3

(58) Field of Classification Search ..... 345/76
See application file for complete search history.

(56) References Cited

U.S. PATENT DOCUMENTS 6,593,905 B1 7/2003 Lay
7,379,282 B1 * 5/2008 Zansky ..... 361/82
2002/0050962 A1 * 5/2002 Kasai ..... 345/76
2003/0112208 A1 6/2003 Okabe et al.
2006/0012310 A1 * 1/2006 Chen et al. ..... 315/169.3
2007/0057873 A1 * 3/2007 Uchino et al. ..... 345/76

FOREIGN PATENT DOCUMENTS

JP 2001195027 7/2001
JP 2003233342 8/2003
TW 479216 3/2002
TW 533398 5/2003

OTHER PUBLICATIONS

TW Office Action mailed Sep. 22, 2008.
English Abstract of TW533398, published May 21, 2003.
English Abstract of TW479216, published Mar. 11, 2002.
English Abstract of JP2001195027, published Jul. 19, 2001.
English Abstract of JP2003233342, published Aug. 22, 2003.

* cited by examiner

*Primary Examiner*—Amr Awad
*Assistant Examiner*—Andre Matthews
(74) *Attorney, Agent, or Firm*—Thomas, Kayden, Horstemeyer & Risley

(57) ABSTRACT

A display unit is provided. The display unit includes a light-emitting diode, a driving transistor, and a power supply system. The light-emitting diode comprises a cathode and an anode. The driving transistor comprises a source, a drain, and a gate, wherein the gate receives a first voltage, the drain is coupled to a second voltage via the light-emitting diode and the gate receives a third voltage. The power supply system is coupled to the drain of the driving transistor, providing the second voltage in response to the voltage of the drain of the driving transistor.

27 Claims, 5 Drawing Sheets

DISPLAY UNIT, ARRAY DISPLAY AND DISPLAY PANEL UTILIZING THE SAME AND CONTROL METHOD THEREOF

BACKGROUND

The invention relates to a display unit, and more particularly, to a display unit employed in an organic light emitting display device.

FIG. 1 is a schematic diagram of a conventional organic light emitting display panel. As shown, the panel 1 comprises a data driver 10, a scan driver 12, and a display array 14. The data driver 10 controls a plurality of data lines $D1_1$ to $D1_n$ and the scan driver 12 controls a plurality of scan lines $S1_1$ to $S1_m$. The display array 14 is formed by multiple data lines $D1_1$ to $D1_n$ and multiple scan lines $S1_1$ to $S1_m$. The intersecting data scan lines correspond to one display unit. For example, data line $D1_1$ and scan line $S1_1$ intersect to form a display unit 100. As with any other display unit, the equivalent circuit of the display unit 100 comprises a switch transistor T10, a storage capacitor Cs1, a driving transistor T11, and an organic light-emitting diode (OLED) D1. The driving transistor T11 is a PMOS transistor, for example.

The scan driver 12 sequentially outputs scan signals to scan lines $S1_1$ to $S1_m$ to turn on the switch transistors within all display units corresponding to one row and turn off the switch transistors within all display units corresponding to all other rows. The data driver 10 outputs video signals with gray level values to the display units corresponding to one row through the data lines $D1_1$ to $D1_n$ according to prepared image data not yet displayed. For example, when the scan driver 12 outputs a scan signal to the scan line $S1_1$, the switch transistor T10 is turned on, the data driver 10 outputs a corresponding video signal to the display unit 100 through the data line $D1_1$, and the storage capacitor Cs1 stores the voltage of the video signal. According to the stored voltage in the storage capacitor Cs1, the driving transistor T11 provides a driving current Id1 to drive the OLED D1 to emit light.

Since the OLED D1 is a current-driving element, brightness of the OLED D1 is determined by the intensity of the driving current Id1. The total brightness of the OLED D1 in a frame cycle is the light-emitting intensity thereof. The driving current Id1 is a drain current of the driving transistor and refers to the driving capability thereof. The driving current Id1 is represented in the following formula:

$$id1=k(vsg1+vth1)^2$$

where id1, k, vsg1 and vth1 represent a value of the driving current Id1, a conduction parameter of the driving transistor T11, a value of the source-gate voltage Vsg of the driving transistor T11, and a threshold voltage of the driving transistor T11 respectively.

As shown in FIG. 1, in conventional organic light emitting display devices, the voltages Vdd1 and Vss1 of each display unit are tied together respectively and provided by an external power supply system. The magnitude of the voltage Vdd1 determines the source-gate voltage Vsg of the driving transistor of display units, and the voltage Vss1 is provided to maintain driving transistor T11 operation in the saturation region. Voltage Vss1 must meet the following condition: Vds<Vgs−Vth1. However, the drain voltage Vd of the driving transistor T11 must be evaluated in the presence of the organic light emitting diode D1 between the voltage source Vss1 and driving transistor T11. Using display unit 100 as an example, the drain voltage Vd of the driving transistor T11 meets the condition Vd=Voled+Vss1 wherein voltage Voled represents the turn-on voltage of the OLED D1. However, since the turn-on voltage Voled of OLEDs increases with time, the magnitude of voltage Vss1 is provided with consideration of turn-on voltage increment of OLEDs. Thus, the voltage Vss1 equals [Vdd−Voled−(the turn-on voltage increment of D1)], enabling the drain voltage Vd of the driving transistor T11 to meet the following condition: Vds<Vgs−Vth1. Nevertheless, in practice, the turn-on voltage of OLEDs does not increase at the beginning but after time, and the turn-on voltage increment of better organic light emitting diodes is not at a great amount. Thus, providing a fixed voltage Vss1 with high magnitude results in extra power consumption, more serious when employed in small products.

SUMMARY

Accordingly, an embodiment of the invention provides a display unit comprising a light-emitting diode, a driving transistor, and a power supply system. The light-emitting diode comprises a cathode, and an anode. The driving transistor comprises a source, a drain and a gate, wherein the gate receives a first voltage, the drain is coupled to a second voltage via the light-emitting diode and the gate receives a third voltage. The power supply system is coupled to the drain of the driving transistor, providing the second voltage in response to the voltage of the drain of the driving transistor.

An array display is further provided. The array display comprises a plurality of data lines, a plurality of scan lines, a plurality of display units, and a power supply system. The data lines cross the scan lines. Each display unit corresponds to one set of data and scan lines and comprises a light-emitting diode comprising a cathode and an anode and a driving transistor comprising a source, a drain and a gate, wherein the gate receives a first voltage, the drain is coupled to a second voltage via the light-emitting diode and the gate receives a third voltage. The power supply system coupled to the drain of at least one driving transistor provides the second voltage in response to the voltage of the drain of the driving transistor.

A display panel is also provided. The display panel comprises a plurality of data lines, scan lines and display units, a data driver, a scan driver, and power supply system. The data lines cross the scan lines. The data driver is coupled to the data lines, outputting a plurality of data signals to the data lines. The scan driver is coupled to the scan lines, outputting a plurality of data signals to the scan lines. Each display unit corresponds to one set of data and scan lines and comprises a light-emitting diode comprising a cathode and an anode and a driving transistor comprising a source, a drain and a gate, wherein the gate receives a first voltage, the drain is coupled to a second voltage via the light-emitting diode and the gate receives a third voltage. The power supply system coupled to the drain of at least one driving transistor provides the second voltage in response to the voltage of the drain of the driving transistor.

A method of controlling a display unit is also provided, wherein the display unit comprises a light-emitting diode, and a driving transistor. The method comprises providing a first voltage to the source of the driving transistor, providing a second voltage via the light-emitting diode to the drain of the driving transistor, providing a third voltage to the gate of the driving transistor, detecting the voltage of the drain of the driving-transistor, and providing the second voltage to the light-emitting diode in response to the detected voltage.

DESCRIPTION OF THE DRAWINGS

The invention is described by way of exemplary embodiments, but not limitations, illustrated in the accompanying drawings in which like references denote similar elements, and in which.

DETAILED DESCRIPTION

Figure 2:
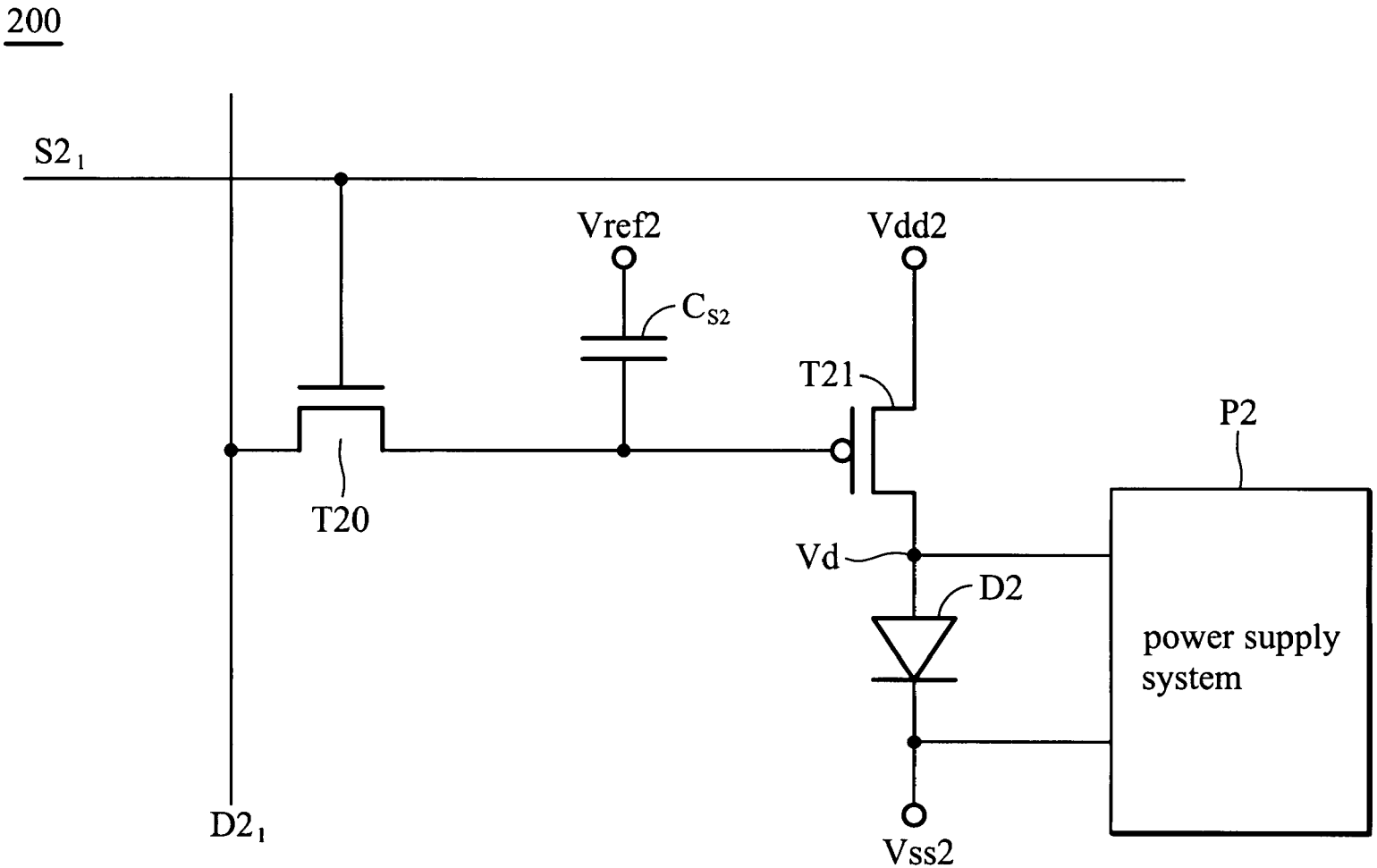
FIG. 2 is a schematic diagram of a display unit of an embodiment of the invention.

FIG. 2 is a schematic diagram of a display unit of an embodiment of the invention. The display unit 200 comprises a switch transistor T20, a storage capacitor Cs2, a driving transistor T21, an organic light emitting diode (OLED) D2, and a power supply system P2. In the display unit 200, a control terminal of the switch transistor T20 is coupled to a scan line $S2_1$, receiving a scan signal, and an input terminal thereof is coupled to a data line $D2_1$. One terminal of the storage capacitor Cs2 is coupled to the driving transistor T21, and the other terminal thereof is coupled to a reference voltage source Vref2. The driving transistor T21, such as a thin film transistor, comprises a gate coupled to the storage capacitor Cs2 and switch transistor T20, receiving a data signal voltage Vdata, a source coupled to the voltage source Vdd2, and a drain coupled to an anode of the OLED D2. A cathode of the OLED D2 is coupled to a voltage source Vss2. The power supply system P2 is coupled to the drain of the driving transistor T21 and the cathode of the OLED DE2, wherein voltage Vss2 is less than voltage Vdd2.

Figure 3:
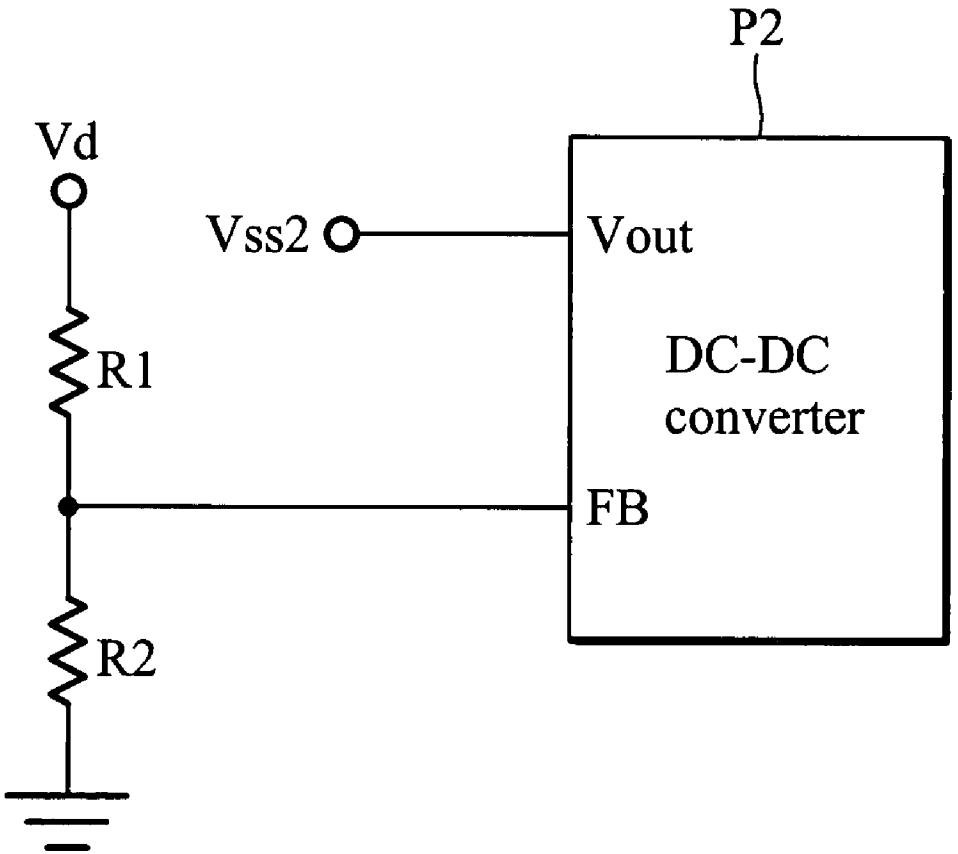
FIG. 3 is a schematic diagram of the power supply system of FIG. 2.

The power supply system P2, preferably a DC-DC Converter such as MAX1733/MAX1734, provides the voltage Vss2 in response to the drain voltage Vd of the driving transistor T21. FIG. 3 is a schematic diagram of the power supply system P2. As shown in FIG. 3, the drain of the driving transistor T21 is coupled to a terminal of a resistor R1 and the other terminal of the resistor R1 is coupled to a FB terminal of the power supply system P2, and a terminal of a resistor R2. The other terminal of resistor R2 is coupled to ground. The output terminal Vout of the power supply system P2 is coupled to the cathode of the OLED D2, providing voltage Vss2. Using MAX1733/MAX1734 DC-DC Converter as an example, the structure of the DC-DC Converter with respect to the two terminals Vout and FB can be arranged as the equation Vss2=Vd(R1/R2+1).

Hence, according to design necessity, the values of resistors R1 and R2 are adjusted to provide the voltage Vss2 to the cathode of the OLED D2 in response to detected drain voltage Vd of the driving transistor T21, thereby maintaining the driving transistor T21 in the saturation region even if the turn-on voltage of the OLED D2 increases. Consequently, extra power consumption is avoided, since the voltage value of Vss2 is no longer fixed, but adjusted according to the detected drain voltage Vd of the driving transistor T21.

Figure 1:
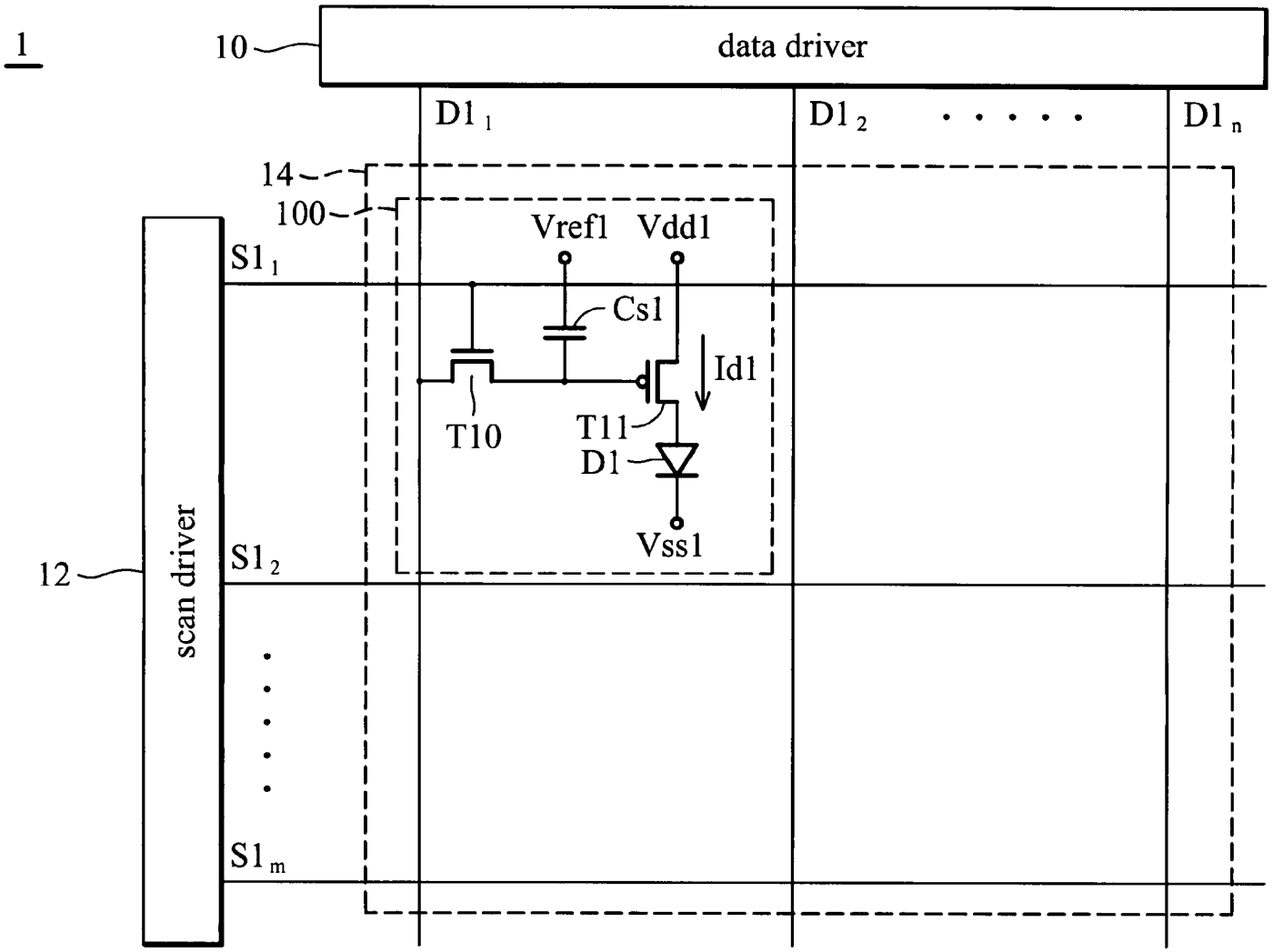
FIG. 1 ( RELATED ART )
FIG. 1 is a schematic diagram of a conventional organic light emitting display panel.
Figure 4:
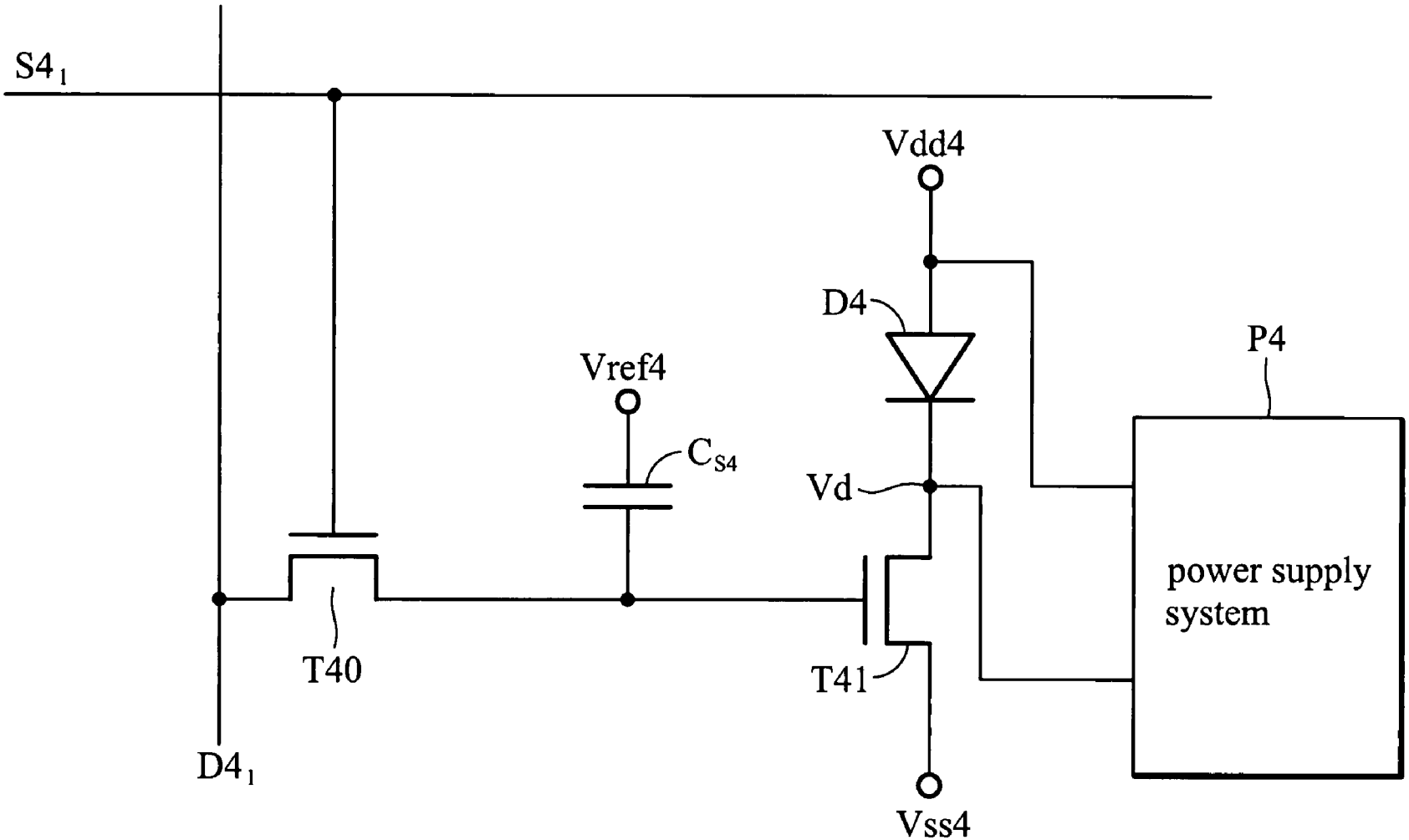
FIG. 4 is a schematic diagram of a display unit of another embodiment of the invention.

Further, the display units of FIG. 2A constitute a display panel of the invention, similar to that shown in FIG. 1, such that details thereof are omitted. It should be noted that in the display panel of the invention, the drain voltages of one display unit or multiple display units thereof are detected for the external power supply system to provide the voltage Vss as disclosed previously. While the driving transistor T21 shown in FIG. 2 is a PMOS transistor, a NMOS transistor shown in FIG. 4 or other components-having the same equivalent circuit can be utilized.

Figure 5:
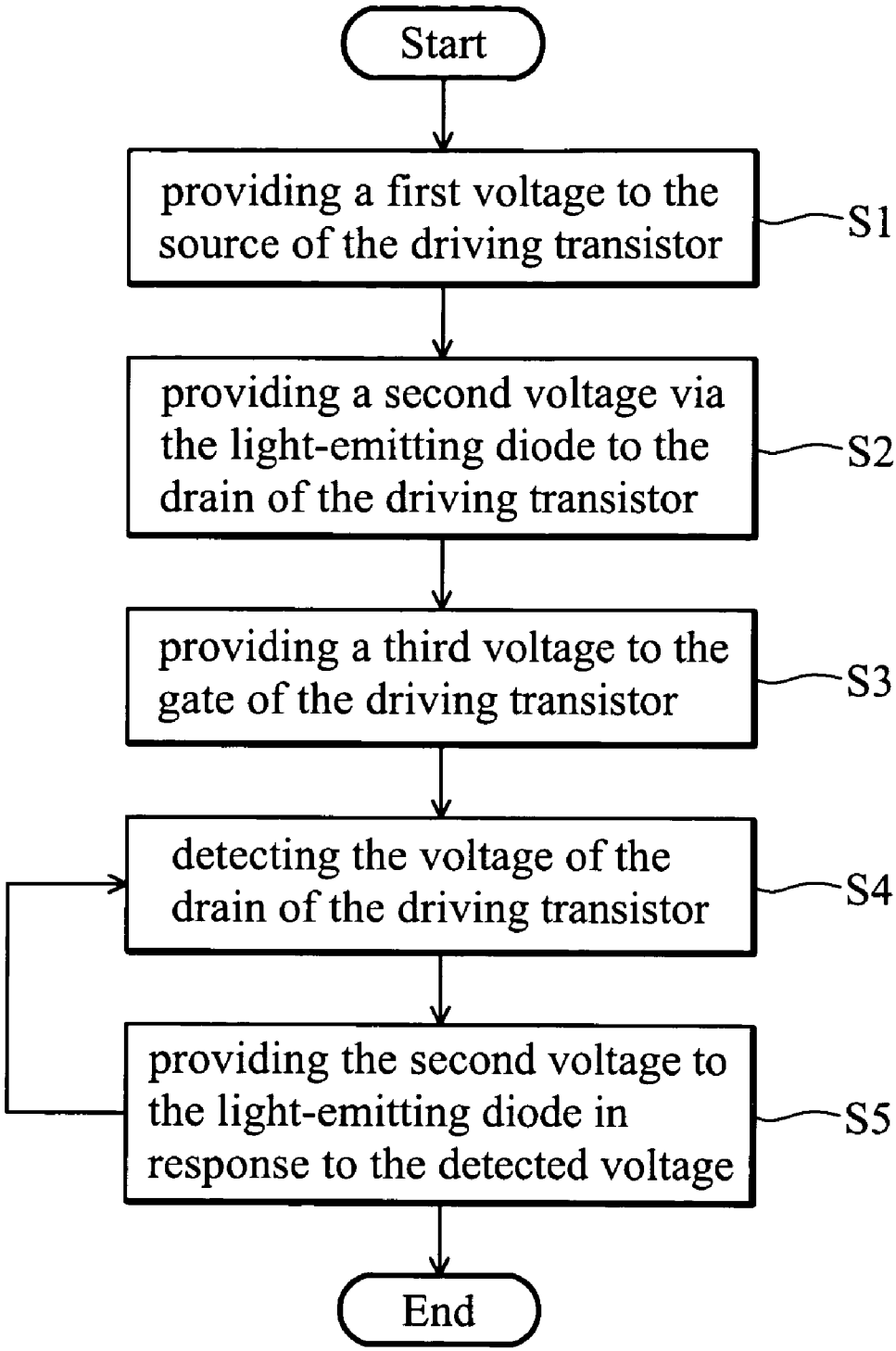
FIG. 5 is a flowchart of a method of controlling a display unit in accordance with an embodiment of the invention.

As shown in FIG. 5, a method of controlling a display unit comprising a light-emitting diode and a driving transistor is provided. The method comprises providing a first voltage to the source of the driving transistor (step S1), providing a second voltage via the light-emitting diode to the drain of the driving transistor (step S2), providing a third voltage to the gate of the driving transistor (step S3), detecting the voltage of the drain of the driving transistor (step S4), and providing the second voltage to the light-emitting diode in response to the detected voltage (step S5), wherein the second voltage is provided to maintain the driving transistor in the saturation region. The method then returns to step 4 wherein the drain voltage of the driving transistor is detected again and then to step S5, wherein the second voltage provided to the light-emitting diode is adjusted in response to possible variations in the detected drain voltage of the driving transistor.

While the invention has been described by way of example and in terms of preferred embodiments, it is to be understood that the invention is not limited thereto. On the contrary, it is intended to cover various modifications and similar arrangements as would be apparent to those skilled in the art. Therefore, the scope of the appended claims should be accorded the broadest interpretation so as to encompass all such modifications and similar arrangements.

What is claimed is:

1. A display unit, comprising:

a light-emitting diode comprising a cathode and an anode;

a driving transistor comprising a source, a drain and a gate, wherein the source is adapted to receive a first voltage, the drain is coupled to a second voltage via the light-emitting diode, and the gate is adapted to receive a third voltage;

a power supply system having a first terminal and a second terminal;

a first resistor coupled between the drain of the driving transistor and the first terminal; and a second resistor coupled between the first terminal and a ground;

wherein the power supply system provides the second voltage according to the voltage of the drain of the driving transistor, the resistance value of the first resistor, and the resistance value of the second resistor.

2. The display unit of claim 1, further comprising:

a reference voltage source;

a switch transistor comprising a gate, a first electrode and a second electrode, wherein the gate is adapted to receive a scan signal, the first electrode is adapted to receive a data signal, and the second electrode is coupled to the gate of the driving transistor; and a storage capacitor coupled between the second electrode of the switch transistor and the reference voltage source.

3. The display unit of claim 1, wherein the driving transistor is a PMOS transistor.

4. The display unit of claim 3, wherein the second voltage is less than the first voltage, the anode of the light-emitting diode is coupled to the drain of the driving transistor, and the cathode of the light-emitting diode is adapted to receive the second voltage.

5. The display unit of claim 1, wherein the driving transistor is an NMOS transistor.

6. The display unit of claim 5, wherein the second voltage is greater than the first voltage, the cathode of the light-emitting diode is coupled to the drain of the driving transistor, and the anode of the light-emitting diode is adapted to receive the second voltage.

7. The display unit of claim 1, wherein the power supply system comprises a DC-DC converter.

8. The display unit of claim 1, wherein the power supply system provides the second voltage according to an equation Vss=Vd(R1/R2+1), Vss represent a value of the second voltage, Vd represents a value of the voltage of the drain of the driving transistor, R1 represents the resistance value of the first resistor, and R2 represents the resistance value of the second resistor.

9. The display unit of claim 1, wherein the power supply system provides the second voltage according to the voltage of the drain of the driving transistor, the resistance value of the first resistor, and the resistance value of the second resistor for maintaining the driving transistor in a saturation region.

10. An array display, comprising:

a plurality of data lines;

a plurality of scan lines crossing the data lines;

a plurality of display units, each corresponding to one set of data and scan lines and comprising:

a light-emitting diode comprising a cathode and an anode; and a driving transistor comprising a source, a drain and a gate, wherein the source is adapted to receive a first voltage, the drain is coupled to a second voltage via the light-emitting diode, and the gate is adapted to receive a third voltage;

a power supply system having a first terminal and a second terminal;

a first resistor coupled between the drain of at least one driving transistor and the first terminal; and a second resistor coupled between the first terminal and a ground;

wherein the power supply system provides the second voltage according to the voltage of the drain of the driving transistor, the resistance value of the first resistor, and the resistance value of the second resistor.

11. The array display of claim 10, wherein each display unit comprises:

a reference voltage source;

a switch transistor comprising:

a gate coupled to a corresponding scan line and adapted to receive a scan signal;

a first electrode coupled to a corresponding data line and adapted to receive a data signal; and a second electrode coupled to the gate of the driving transistor; and a storage capacitor coupled between the second electrode of the switch transistor and the reference voltage source.

12. The array display of claim 10, wherein the driving transistor is a PMOS transistor.

13. The array display of claim 12, wherein the second voltage is less than the first voltage, the anode of the light-emitting diode is coupled to the drain of the driving transistor, and the cathode of the light-emitting diode is adapted to receive the second voltage.

14. The array display of claim 10, wherein the driving transistor is an NMOS transistor.

15. The array display of claim 14, wherein the second voltage is greater than the first voltage, the cathode of the light-emitting diode is coupled to the drain of the driving transistor, and the anode of the light-emitting diode is adapted to receive the second voltage.

16. The array display of claim 10, wherein the power supply system comprises a DC-DC converter.

17. The array display of claim 10, wherein the power supply system provides the second voltage according to an equation Vss=Vd(R1/R2+1), Vss represent a value of the second voltage, Vd represents a value of the voltage of the drain of the driving transistor, R1 represents the resistance value of the first resistor, and R2 represents the resistance value of the second resistor.

18. The array display of claim 10, wherein the power supply system provides the second voltage according to the voltage of the drain of the driving transistor, the resistance value of the first resistor, and the resistance value of the second resistor for maintaining the driving transistor in a saturation region.

19. A display panel, comprising:

a plurality of data lines;

a plurality of scan lines crossing the data lines;

a data driver, coupled to the data lines, for applying a plurality of data signals to the data lines;

a scan driver, coupled to the scan lines, for applying a plurality of data signals to the scan lines;

a plurality of display units, each corresponding to one set of the data and scan lines and comprising:

a light-emitting diode comprising a cathode and an anode; and a driving transistor comprising a source, a drain and a gate, wherein the source is adapted to receive a first voltage, the drain is coupled to a second voltage via the light-emitting diode, and the gate is adapted to receive a third voltage;

a power supply system having a first terminal and a second terminal;

a first resistor coupled between the drain of at least one driving transistor and the first terminal; and a second resistor coupled between the first terminal and a ground;

wherein the power supply system provides the second voltage according to the voltage of the drain of the driving transistor, the resistance value of the first resistor, and the resistance value of the second resistor.

20. The display panel of claim 19, wherein each display unit further comprises:

a reference voltage source;

a switch transistor comprising:

a gate coupled to a corresponding scan line and adapted to receive one scan signal;

a first electrode coupled to a corresponding data line and adapted to receive one data signal; and a second electrode coupled to the gate of the driving transistor; and a storage capacitor coupled between the second electrode of the switch transistor and the reference voltage source.

21. The display panel of claim 19, wherein the driving transistor is a PMOS transistor.

22. The display panel of claim 21, wherein the second voltage is less than the first voltage, the anode of the light-emitting diode is coupled to the drain of the driving transistor, and the cathode of the light-emitting diode is adapted to receive the second voltage.

23. The display panel of claim 19, wherein the driving transistor is an NMOS transistor.

24. The display panel of claim 23, wherein the second voltage is greater than the first voltage, the cathode of the light-emitting diode is coupled to the drain of the driving transistor, and the anode of the light-emitting diode is adapted to receive the second voltage.

25. The display panel of claim 19, wherein the power supply system comprises a DC-DC converter.

26. The display panel of claim 19, wherein the power supply system provides the second voltage according to an equation Vss=Vd(R1/R2+1), Vss represent a value of the second voltage, Vd represents a value of the voltage of the drain of the driving transistor, R1 represents the resistance value of the first resistor, and R2 represents the resistance value of the second resistor.

27. The display panel of claim 19, wherein the power supply system provides the second voltage according to the voltage of the drain of the driving transistor, the resistance value of the first resistor, and the resistance value of the second resistor for maintaining the driving transistor in a saturation region.

* * * * *